United States Patent [19]

Sogi et al.

[11] Patent Number: 4,803,118

[45] Date of Patent: Feb. 7, 1989

[54] COMPOSITE CUSHION

[75] Inventors: Hidehito Sogi, Aichi; Toshiyuki Hori, Chiba, both of Japan

[73] Assignees: E. I Du Pont de Nemours and Company, Wilmington, Del.; Toyo Tire & Rubber Company, Osaka, Japan

[21] Appl. No.: 179,553

[22] Filed: Apr. 8, 1988

[51] Int. Cl.[4] ..... B32B 3/26; B32B 7/00

[52] U.S. Cl. ..... 428/246; 428/257; 428/258; 428/259; 428/316.6; 428/317.9

[58] Field of Search ..... 428/246, 257, 258, 259, 428/316.6, 317.9

[56] References Cited

U.S. PATENT DOCUMENTS

| | | | |
|---|---|---|---|
| 3,763,858 | 10/1973 | Buese | 428/319.7 |
| 4,208,469 | 6/1980 | Dial | 428/319.7 |
| 4,208,696 | 6/1980 | Lindsay et al. | 428/319.7 |
| 4,606,968 | 8/1986 | Thornton et al. | 428/259 |

*Primary Examiner*—William J. Van Balen

[57] ABSTRACT

A composite cushion, useful for vehicle transportation, furniture and bedding, of foam having a fabric embedded therein which provides a spring function, good seating comfort and soft suspension, and which maintain its shape and desirable properties for a long period.

4 Claims, 3 Drawing Sheets

COMPOSITE CUSHION

BACKGROUND OF THE INVENTION

Conventionally, many types of foam have been used as a seat cushion to form the entire body of the cushion. Polyurethane foam has been so used and has provided excellent cushioning. However, when such foams are used for the entire cushion, local transformation of the bearing surface often generates fatigue in the user over a lengthy period. In addition, insufficient surface strength in relation to the applied localized strength reduces the durability of such cushions.

To correct such defects, systems have been proposed wherein reinforcing materials have been incorporated into the seat. For example, the seating surface of a foam cushion has been reinforced by a sheet produced by heat-melting one face of a foam sheet. This technique is disclosed in Japanese Patent Application laid open No. 57-772. A different system for reinforcement is shown in Japanese Patent Application laid open No. 61-170360, which discloses embedding an oriented plastic filament in the surface of a polyurethane foam object.

Still another earlier method of reinforcement is disclosed in Japanese Patent Application laid open No. 61-234806. There, films or sheets are interposed into a foam cushion, the interposed films or sheets having a different hardness than the foam. Specifically, this patent application shows a composite cushion comprising a lamination of cushions having 25% compression hardness (JIS K6401) of greater than 15 kG/200 mm diameter and those having that of less than 14 kG/200 mm diameter with the interposition of sheets into them.

Still other cushions have been formed from polyurethane foam differing in hardness on the top and bottom bearing surfaces and both sides. In this system, which is disclosed in Japanese Patent Application laid open No. 61-137732, the cushion is combined with matted filament impregnated with binder.

Still other prior methods of reinforcement, as described in Japanese Patent Application laid open No. 59-80212, involved the combination of foam with metal spring components or by tensioning filament materials onto a frame. However, such constructions are not entirely satisfactory, from a variety of performance and manufacturing aspects.

As noted above, previous foam reinforcement with filaments or sheet materials have provided ordinal warp and weft reinforcement of the same degree. In other words, the resulting construction was a sheet having great rigidity, with no synergistic spring function.

As discussed above, cushions prepared entirely from soft foam often result in a sense of fatigue in the seat occupant. Even combinations of low and high density foams or various reinforcing components have not been satisfactory. Moreover, formation of a cushion entirely from foam with high density makes it impossible to obtain a favorable soft sense of contact. Cushions having fabric reinforcement are inferior to spring suspension systems.

A need therefore exists for reinforcement material having a spring function that provides improvement in the performance of soft foam cushions such as those used for chairs and bedding, and which provides a desirable resilience or bounce in the vertical direction. Another continuing need to which the present invention is directed is the provision of cushioning materials which have reduced thickness without the bottoming that so often accompanies a decrease in thickness.

SUMMARY OF THE INVENTION

The instant invention provides reinforced cushioning materials having a spring suspension function showing excellent damping characteristics, and which eliminates the balanced rigid textiles that have previously been used, the present cushioning materials providing excellent resilience, creep and dimensional stability.

Specifically, there is provided a composite cushion comprising at least two layers of foam having embedded therebetween at least one layer of fabric parallel to the planes of the foam layers, the fabric having a warp and a weft which are joined at the intersections, the fabric comprising a weft of elastomeric monofilament with a filament size of 0.125 mm–1.5 mm and a warp of yarn or elastomeric monofilament, the foam cushion having a spring function which is a composite of the individual components of the cushion.

DETAILED DESCRIPTION OF THE INVENTION

Figure 1:
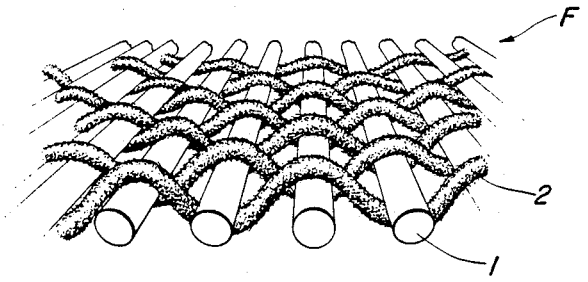
FIG. 1 is a magnified view of a fabric which can be used in this invention.

The fabric used in the present composite cushions has a warp and a weft that are joined at the intersections. The weft can be an elastomeric monofilament with excellent spring and having high elasticity. For the warp, yarn or elastomeric monofilament can be used. To maintain the dimensional stability, the fabrics are combined by contact or fusion at the intersecting point. The use of elastomeric monofilament for the warp combined with weft is appropriate for supporting the vertical and horizontal directions with similar characteristics, as a general buffering cushion. In this case, the warp size may be equivalent to the weft size, but, to provide efficient weft spring, it is more desirable to make the warp smaller in size. A warp count less than the number of weft picks is desirable.

With the above considerations, an elastomeric weft filament is used having a diameter in the range of 0.125 mm–1.5 mm and a combination of various monofilament sizes or numbers of picks (number of monofilaments at the pick interval of 2.54 cm). This makes it possible to obtain the required spring constants and various suspension functions. If the desired properties cannot be obtained by adjustment of weft, diameter and number of picks in a fabric, then two or more layers of fabric can be used to provide the desired properties. Especially, the composite cushion of this invention, having an embedding reinforcement structure having an individual unit spring function of foam cushion, has a composition capable of obtaining favorable seating comfort and seating conformation with support by horizontal directional bed to the pressure unit such as above-knee unit, by embedding unification by setting the fabric weft direction to for example, seat (seater) horizontal direction.

If the elastomeric monofilament size is 0.35 mm, an example of types of number of picks (grade) is illustrated in Table I.

TABLE I

| Grade | Number of Picks (number/2.54 cm) |
|---|---|
| A | 7.5 |
| B | 12.0 |
| C | 14.0 |
| D | 17.5 |
| E | 21.0 |

The performance of the fabric will vary with the monofilament diameter, number of pieces or monofilament fundamental polymer is in the constant area.

The following is an example of fabric weft and warp.

TABLE II

| Grade | Number of weft picks (number/25.4 mm) | Number of warp picks (number/25.4 mm) |
|---|---|---|
| F | 27 | 44 |
| G | 12 | 40 |

In this fabric, the weft is an elastomeric monofilament and has a filament size of approximately 0.36 mm. The warp is a 30's 2-ply cotton count polyester staple yarn having a denier of approximately 350.

The warp yarn, according to application, is a nonelastomer. The yarn can vary in form, and can include, for example, staple yarn or multi-filament yarn.

The composite cushion of this invention, as mentioned above, contains a fabric sheet having a weft of elastomeric monofilament, so it can exhibit an elastic suspension function having favorable high restoration. The fusion of the warp and weft at the points of intersection results in long term maintenance of elastomeric monofilament position and high tear strength, and, in addition, prevents crowding and slipping of the filaments in the fabrics. Therefore, the initial form of the foam cushion reinforced by the fabric is maintained for a long period. A combination of fabrics with various elastomeric monofilament sizes and numbers of picks permits obtaining favorable spring constants, damping function and spring suspension function. The present composite cushions result in a decrease of weight by reducing the cushion thickness.

Cushions reinforced by embedding the fabric so that the major elastomeric monofilament, in the weft of the fabric, is in the horizontal direction of foam cushion, provide a suspension function capable of favorable seating comfort and seating conformation. Such cushions also exhibit excellent damping characteristics.

Cushions reinforced by embedding the fabric in soft foam by setting the fabric weft in the horizontal direction, and also embedding fabric in the bolsters of foam rising on both sides of the seat, can result in satisfactory spring support and excellent seating comfort.

In the Figures, 1 refers to an elastomeric monofilament weft; 2 refers to the warp of a reinforcing fabric; 3, 6, 7 refer to reinforcing fabrics themselves; and 4, 5, and 8 refer to foam cushions or parts thereof.

FIG. 1 shows an enlarged view showing an example of a fabric F used for reinforcement in this invention. 1 is a weft comprising elastomeric monofilament which has been treated by drawing and 2 is a warp comprising polyester staple yarn.

The physical properties of three grades of fabric prepared from polyester elastomeric monofilament having a diameter of 0.35 mm are illustrated in Table III.

TABLE III

| Physical Property | Grade A | Grade B | Grade C |
|---|---|---|---|
| Number of picks (Strands/2.54 cm) | 7.5 | 12.0 | 14.0 |
| Spring constant (N/% strain/cm) | 0.9 | 1.4 | 1.8 |
| Maximum strength (N/cm width) | 62 | 96 | 117 |

Note: N = Newton

Figure 2:
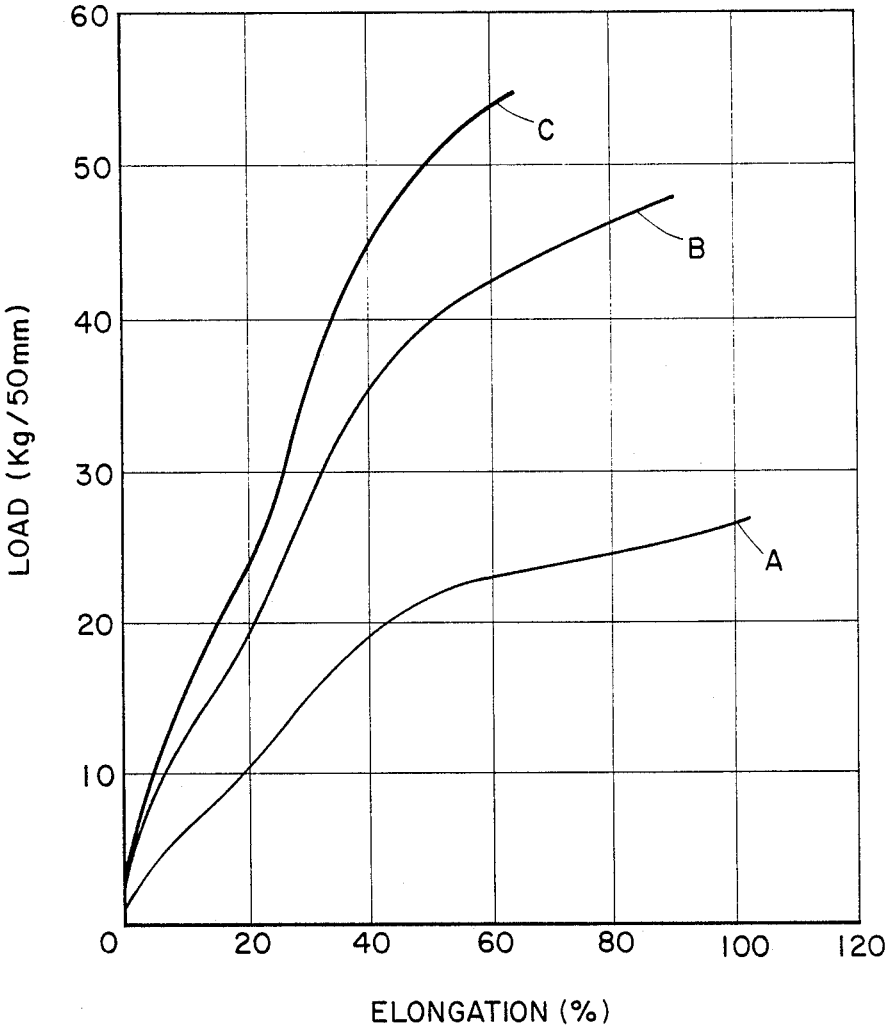
FIG. 2 is a graphical representation of the extension characteristics of fabrics used in this invention.

The extension characteristics of the above grades are illustrated in FIG. 2. That Figure shows load (kg/50 mm) on the vertical axis and extension (%) on the horizontal axis. As illustrated in the Figure, deflection at constant load decreases in the sequence of grades A, B, C.

Figure 3:
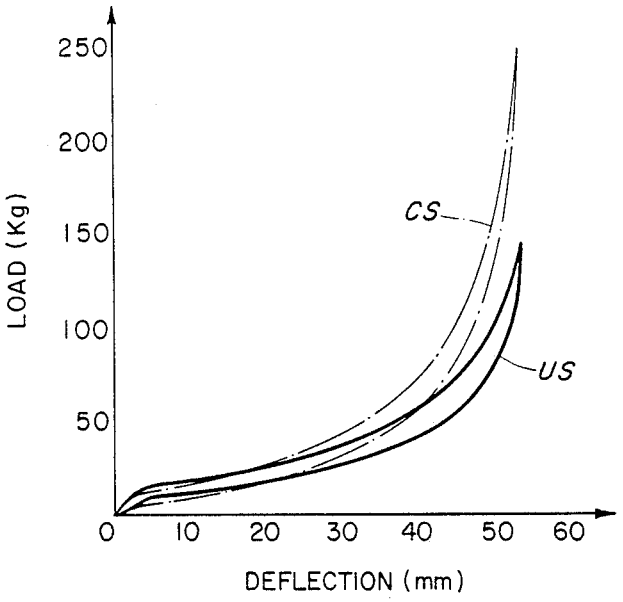
FIG. 3 is a hysteresis curve showing a comparison of fabrics and foam, composite sample CS and foam sample US, load and deflection volume.

FIG. 3 shows an example of a hysteresis curve comparison of load (kg) and deflection (mm) relations of composite sample CS of fabric C of the above grade C and polyurethane with a thickness of 70 mm and sample US of polyurethane foam with a thickness of 70 mm. In that Figure, CS is the hysteresis curve of the composite sample and US is that of the polyurethane foam sample. As illustrated by this curve, with deflection of up to 25 mm, composite sample CS shows a movement approximately equivalent to polyurethane foam sample US and their softness is approximately equal. If the deflection value is greater than 25 mm, CS has greater load than US, at the same deflection. This increases support and shows elastic function of elastomeric monofilament. For the measuring method used in these comparisons, the measurement is conducted by immediately removing the load after pushing the circular pressure plate having a diameter of 200 mm to thickness of 75% at the speed of 50 mm/min.

The following Figures show representative examples wherein the reinforcement fabrics have a spring function as required in this invention. In other words, fabrics comprising elastomeric monofilament weft and yarn warp are applied as embedded reinforcement in the foam cushion unit.

Figure 4:
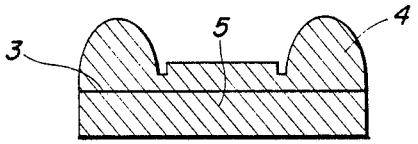
FIG. 4 is a schematic sectional view of a composite cushion of this invention.
Figure 5:
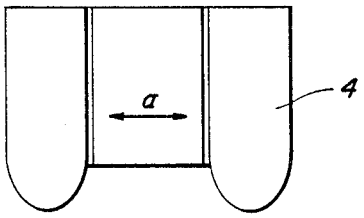
FIG. 5 is a schematic top view of the composite cushion of FIG. 4.

FIG. 4 is a schematic cross-sectional drawing showing a composite cushion of this invention and FIG. 5 is a schematic top drawing of the cushion of FIG. 4. In these Figures, 3 is a fabric, 4 is an upper foam cushion forming the upper layer of a seat and 5 is a lower foam cushion forming the lower layer of the seat.

These Figures show embedding fabrics into a seat cushion of foam such as polyurethane. In this example, the reinforcing fabric is embedded so that the weft direction of elastomeric monofilament is in the horizontal direction of seat cushion, as illustrated in the drawing. In FIG. 5, the direction of arrow (a) illustrates the direction in which the weft of the reinforcing fabric is to be set.

Products of this type are made by conducting the following molding operations. In this procedure, the mold is positioned so that portion of the mold forming the the top of the cushion is on the bottom during the molding operations. The reinforcing fabric is mounted on the mold which forms the top section of the cushion, so that the fabric is at the bottom of the top section. The foam solution is injected into the lower mold for the top part of the cushion. The section of the mold for the top part of the cushion is closed and the foam solution is heated. The portion of the mold for the top of the cushion is opened and the foam solution for the bottom part of the cushion is injected, the mold closed and heated to cure the foam solution which forms the bottom part of the cushion. The mold is then opened and the cushion removed.

Figure 6:
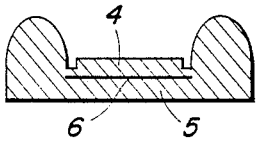
FIG. 6 is a schematic sectional view of another composite cushion of this invention.
Figure 7:
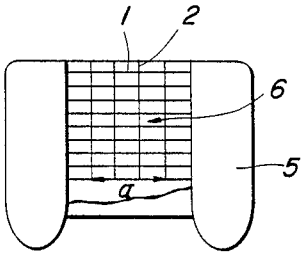
FIG. 7 is a schematic top view of the composite cushion of FIG. 7, partly cut away to show the embedded fabric.

FIG. 6 is a schematic sectional drawing showing another embodiment of a composite cushion of this invention. FIG. 7 a schematic top drawing of the cushion of FIG. 6, partly cut away to show the embedded reinforcing fabric.

In the drawing, 4 and 5 refer to portions of a foam cushion, having reinforcing fabrics 6, which have wefts 1 and warps 2. Arrow (a) shows the weft direction of the embedded fabrics. This example shows embedding of fabric only into the bearing surface outer layer, as illustrated in fabric 6. The fabric is more clearly shown in FIG. 7, which is partly cut away to show the embedded fabric. The fabric is embedded by setting the weft direction of the fabric in the direction of arrow (a). A desirable combination of performance characteristics can be obtained if the reinforcing fabric does not extend completely to the front of the seat.

Embedding of fabrics into the bearing surface outer layer improves support, dissipates local compressive strength by fabrics with the special structure of this invention, provides proper seating comfort simultaneously, in the case of vehicles, on control of the accelerator, brake, and clutch. The original soft comfort of the foam is retained, and so, no feeling of physical discomfort occurs.

Figure 8:
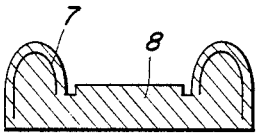
FIG. 8 is a schematic sectional view of still another composite cushion of this invention.
Figure 9:
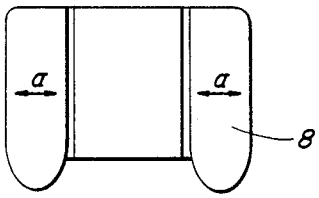
FIG. 9 is a schematic top view of the composite cushion of FIG. 8.

FIG. 8 is a schematic sectional drawing of another composite cushion of this invention. FIG. 9 is a top view of the same cushion. In FIG. 8, fabrics 7 have their wefts embedded in an arch shape, on either side of foam cushion 8.

In conventional technology, due to an increase in support from the bolster of the seat on both sides, foam with hardness greater than the bearing surface is used, or other measures for hardening are used such as stuffing matted filaments. However, foam with a high degree of hardness does not provide a favorable feeling of softness. Reinforcement by stuffing of matted filaments greatly depreciates the elasticity of a soft foam cushion and does not effectuate foam characteristics. Therefore, the seat on both sides requires a feeling of softness upon contact, together with proper support. So, in the example shown in FIGS. 8 and 9, side support of seat is improved while providing, at the same time, a composite cushion with comfortable softness. In other words, elastomeric monofilament wefts of fabrics used in this invention are embed-unified in an arch shape in the direction of the arrow illustrated in FIG. 9, on both sides of the bolster of horizontal directional soft foam of the bearing surface. Therefore, by spring reinforcement of arch shape elastomeric monofilament, local compression strength fed to the fabric reinforcement is dissipated and favorable support and favorable soft comfort without pressure are obtained. Since the embedded elastomeric monofilaments are combined with warp yarn at the intersection of warp yarn, the initial shape of the embedded foam is maintained for a long period, without the breakdown that is typical of other reinforcing fabrics.

Composite cushions of the present invention can also be used in bedding. There, the use of the reinforcing fabrics comprising the elastomeric monofilaments provides a comfortable elastic support for a long period.

The composite cushions of this invention exhibit excellent durability, maintaining their initial cushion form for a long period, showing a suspension function having excellent elasticity and damping. The embedded fabrics, having elastomeric monofilament, provide favorable seating comfort without physical discomfort from the seating. The fabric in the present composite structures, bonded at the intersections, eliminates local transformation on the seating surface, and eliminates the feeling of fatigue and bottoming caused by sitting for a long period, as is experienced with a conventional full foam type of cushion.

The fabrics used in the present structures, comprising elastomeric monofilament, take full advantage of the foam cushioning, to a much greater extent than combinations of soft and hard foam or soft foam with embedded elastic membranes. The present composite cushions also make it possible to create a soft seat which is more comfortable than foam combined with metal springs, while also providing a structure which has decreased weight and is more compact. The thickness of foam needed for the present composite cushions is less than conventional constructions.

We claim:

1. A composite cushion comprising at least two layers of foam having embedded therebetween at least one layer of fabric parallel to the planes of the foam layers, the fabric woven having a warp and a weft which are joined at the intersections, the fabric comprising a weft of elastomeric monofilament with a filament size of 0.125 mm–1.5 mm and a warp of yarn or elastomeric monofilament, the cushion having a spring function which is a composite of the individual components of the foam cushion.

2. A composite cushion of claim 1 comprising at least two layers of fabric, in which the wefts in the layers of fabric differ in either or both of the number of picks or types of monofilament.

3. A composite cushion of claim 1 wherein the polymer used in the weft and warp filaments differ.

4. A composite cushion of claim 2 wherein the polymer used in the weft and warp filaments differ.

* * * * *